US011375777B2

(12) United States Patent
Yoshie

(10) Patent No.: US 11,375,777 B2
(45) Date of Patent: Jul. 5, 2022

(54) SIDE-RELEASE BUCKLE

(71) Applicant: YKK CORPORATION, Tokyo (JP)

(72) Inventor: Kenichi Yoshie, Kurobe (JP)

(73) Assignee: YKK CORPORATION, Tokyo (JP)

( * ) Notice: Subject to any disclaimer, the term of this patent is extended or adjusted under 35 U.S.C. 154(b) by 174 days.

(21) Appl. No.: 16/646,966

(22) PCT Filed: Sep. 15, 2017

(86) PCT No.: PCT/JP2017/033603
§ 371 (c)(1),
(2) Date: Mar. 12, 2020

(87) PCT Pub. No.: WO2019/053904
PCT Pub. Date: Mar. 21, 2019

(65) Prior Publication Data

US 2020/0205528 A1 Jul. 2, 2020

(51) Int. Cl.
*A44B 11/25* (2006.01)
*A44C 5/20* (2006.01)

(52) U.S. Cl.
CPC ..... *A44B 11/25* (2013.01); *A44C 5/2066* (2013.01)

(58) Field of Classification Search
CPC ..... A44B 11/25; A44B 11/266; A44C 5/2066
See application file for complete search history.

(56) References Cited

U.S. PATENT DOCUMENTS 5,737,810 A * 4/1998 Krauss ..... A44B 11/266 24/625
5,774,956 A * 7/1998 French ..... A44B 11/263 24/616
5,791,026 A * 8/1998 Anscher ..... A44B 11/266 24/615
5,893,199 A * 4/1999 Anscher ..... A44B 11/266 24/625
6,263,548 B1 * 7/2001 Ikeda ..... A44B 11/266 24/625
D447,090 S * 8/2001 Kamagata ..... D11/218
(Continued)

FOREIGN PATENT DOCUMENTS

JP 2007021224 A 2/2007
JP 2009011492 A 1/2009
(Continued)

OTHER PUBLICATIONS

International Search Report and Written Opinion for PCT App No. PCT/JP2017/033603 dated Nov. 7, 2017, 7 pgs.

*Primary Examiner* — Robert Sandy
*Assistant Examiner* — Louis A Mercado
(74) *Attorney, Agent, or Firm* — Procopio, Cory, Hargreaves & Savitch LLP

(57) ABSTRACT

A side-release buckle includes a plug and a socket for inserting and engaging the plug, and when a cross section of the engaging surface is observed from an in-plane direction of the first mold mating surface defined by a first parting line of the plug, and from an direction perpendicular to an insertion direction, a surface to be engaged is located on the opposite side to a first belt winding portion with respect to the first mold mating surface, and has a first engaging surface forming an angle $A_1$ with the first mold mating surface of 87° or more and 90° or less.

11 Claims, 7 Drawing Sheets

(56) References Cited

U.S. PATENT DOCUMENTS

| | | | | | |
|---|---|---|---|---|---|
| D459,271 | S | * | 6/2002 | Uehara | D11/216 |
| 6,457,219 | B1 | * | 10/2002 | Liu | A44B 11/266 24/615 |
| D468,664 | S | * | 1/2003 | Nishida | D11/216 |
| D471,131 | S | * | 3/2003 | Kawamura | D11/216 |
| D471,486 | S | * | 3/2003 | Uehara | D11/216 |
| D471,487 | S | * | 3/2003 | Uehara | D11/216 |
| 2002/0133922 | A1 | * | 9/2002 | Uehara | A44B 11/266 24/615 |
| 2007/0017074 | A1 | | 1/2007 | Pontaoe | |
| 2009/0007391 | A1 | | 1/2009 | Uehara | |
| 2016/0278488 | A1 | | 9/2016 | Kaneko et al. | |

FOREIGN PATENT DOCUMENTS

| | | | |
|---|---|---|---|
| JP | 2010022807 | A | 2/2010 |
| JP | 3197854 | U | 6/2015 |
| WO | 2014103009 | A1 | 7/2014 |

* cited by examiner

[FIG. 1-1]
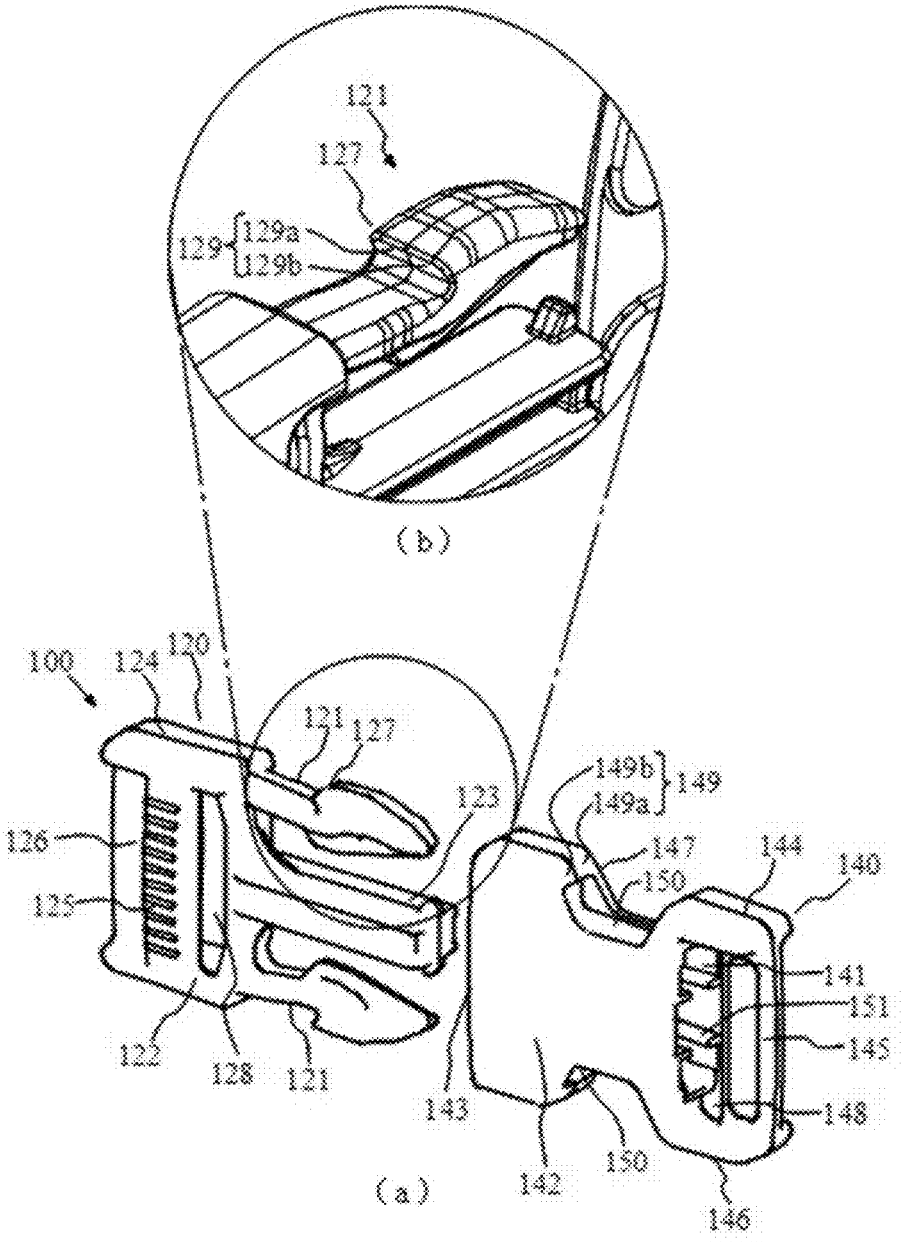

[FIG. 1-2]
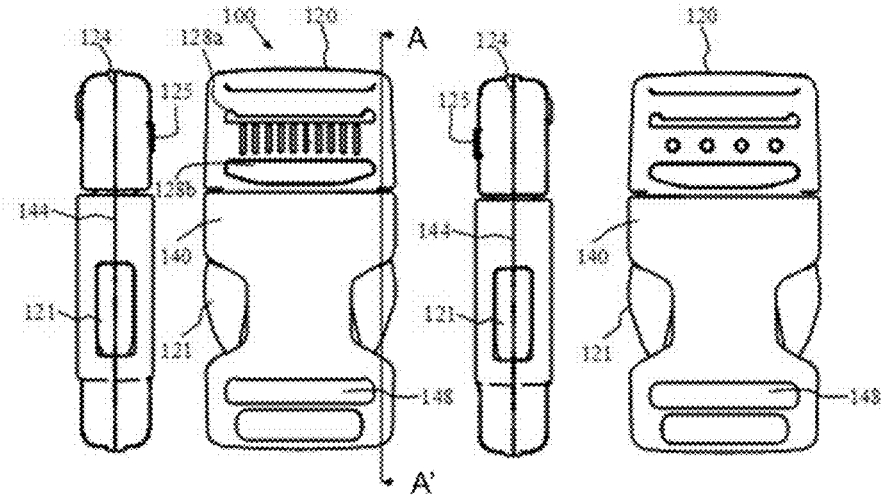
Left side view Front view Right side view Rear view
<Standing state>
[FIG. 1-3]
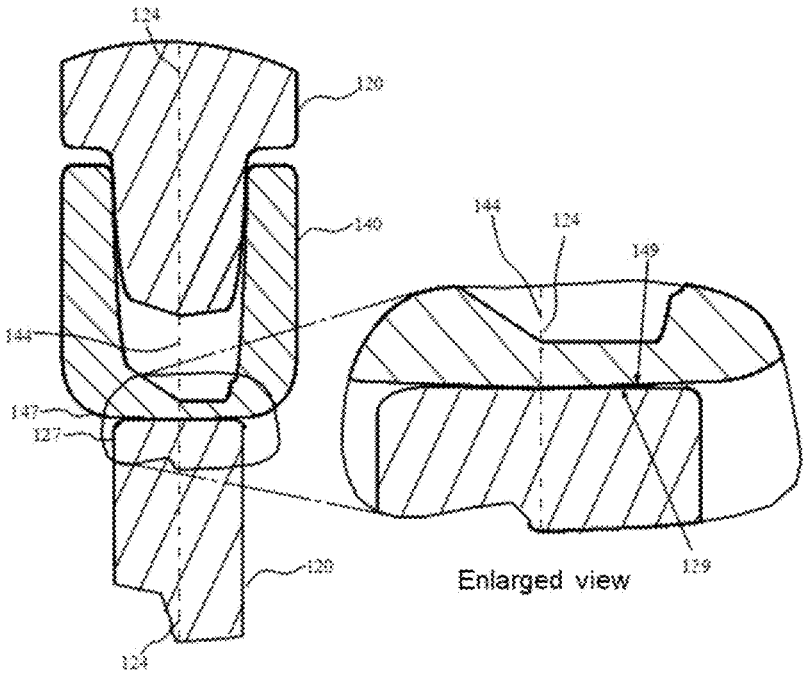
Enlarged view
Partial cross-sectional view taken along line A-A'

[FIG. 1-4]
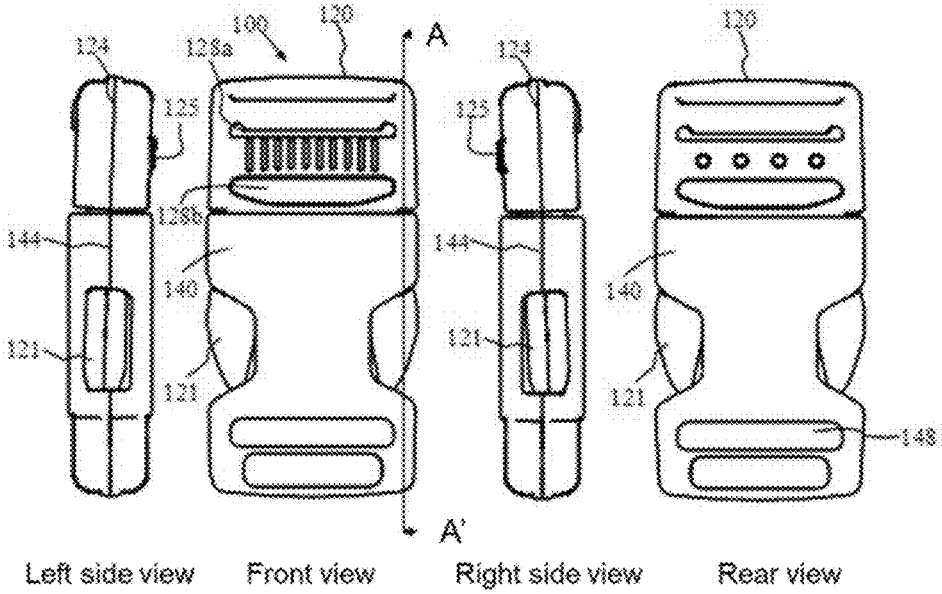
<Bent forward state>
[FIG. 1-5]
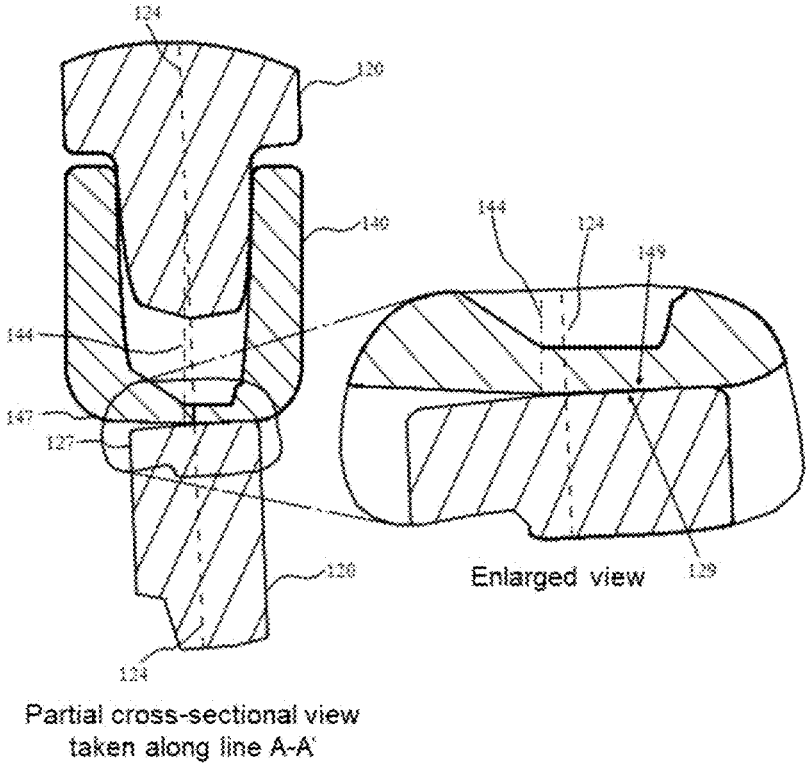

[FIG. 1-6]
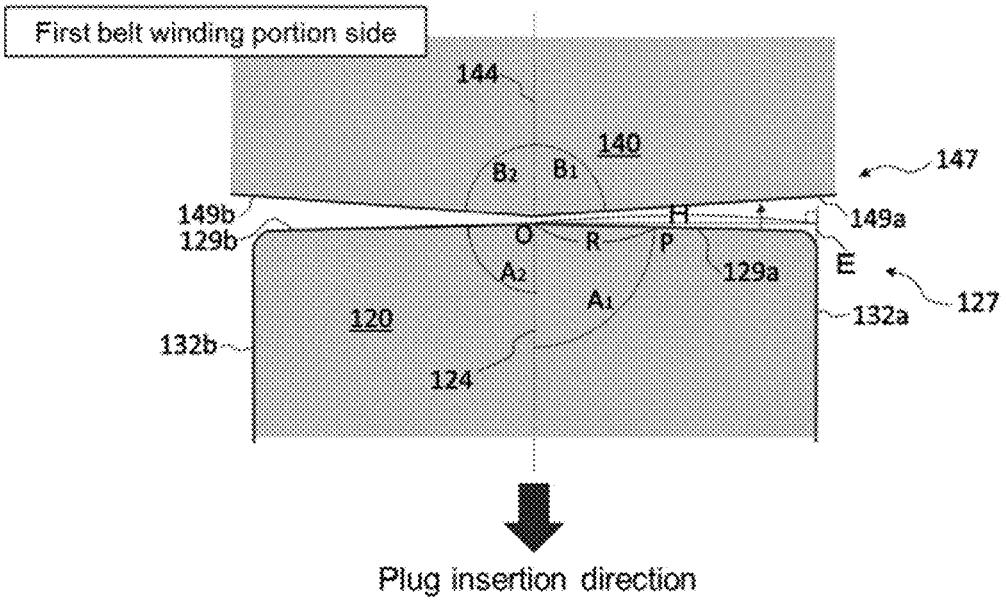
[FIG. 1-7]
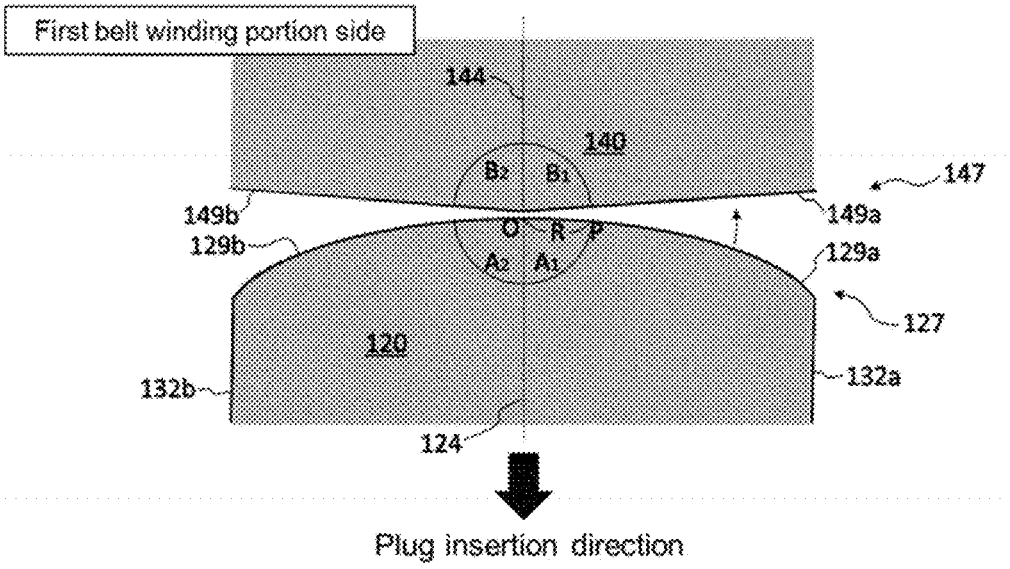

[FIG. 2-1]
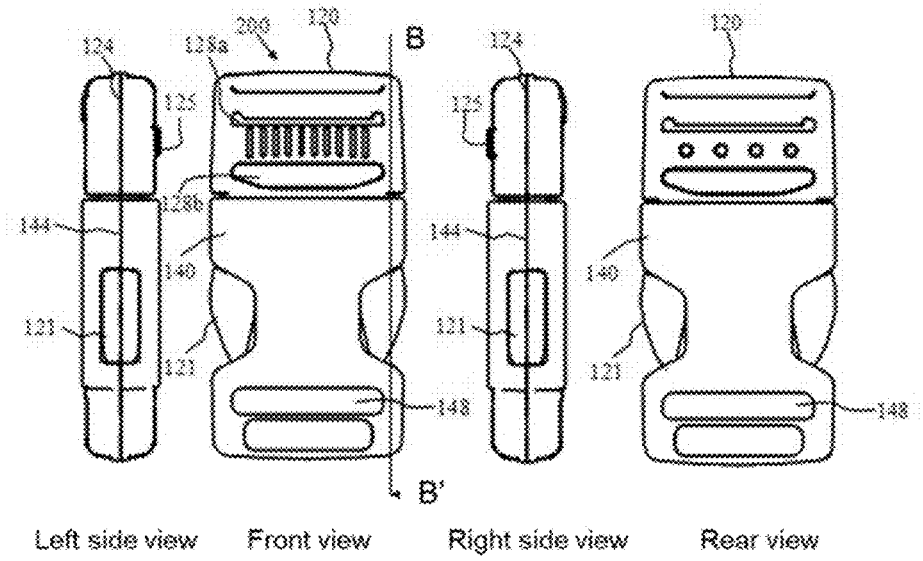
<Standing state>
[FIG. 2-2]
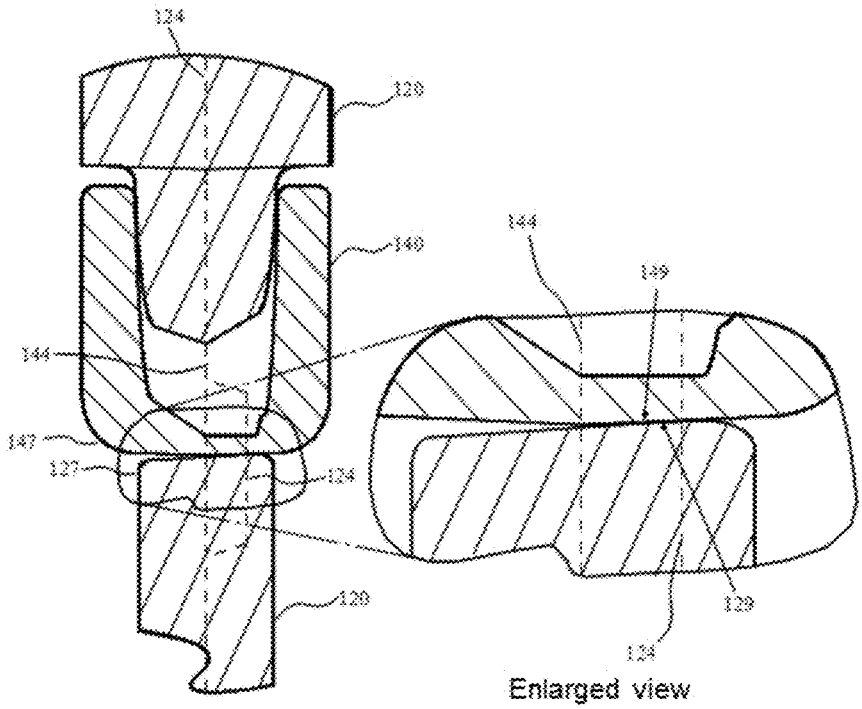
Partial cross-sectional view
taken along line B-B'

[FIG. 2-3]
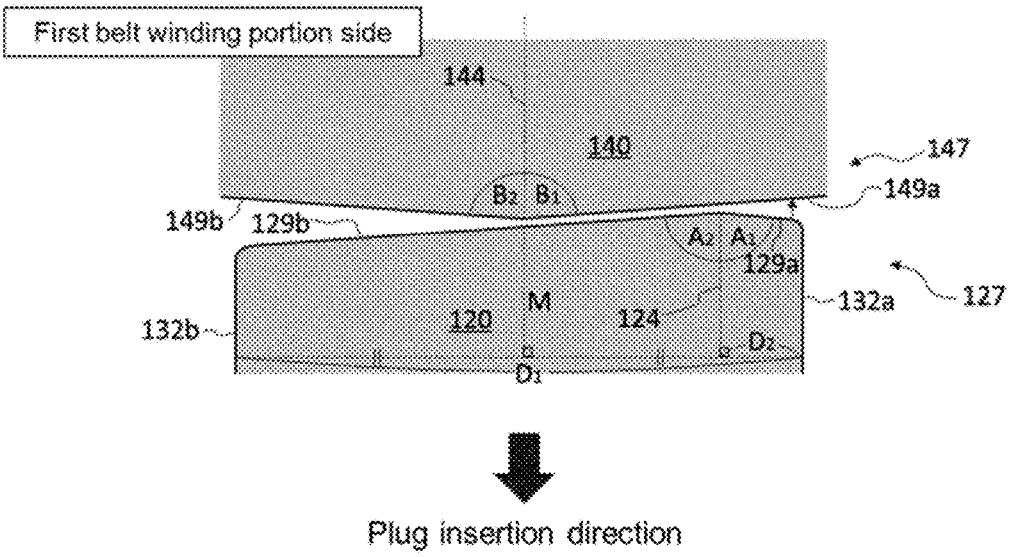
[FIG. 3-1]
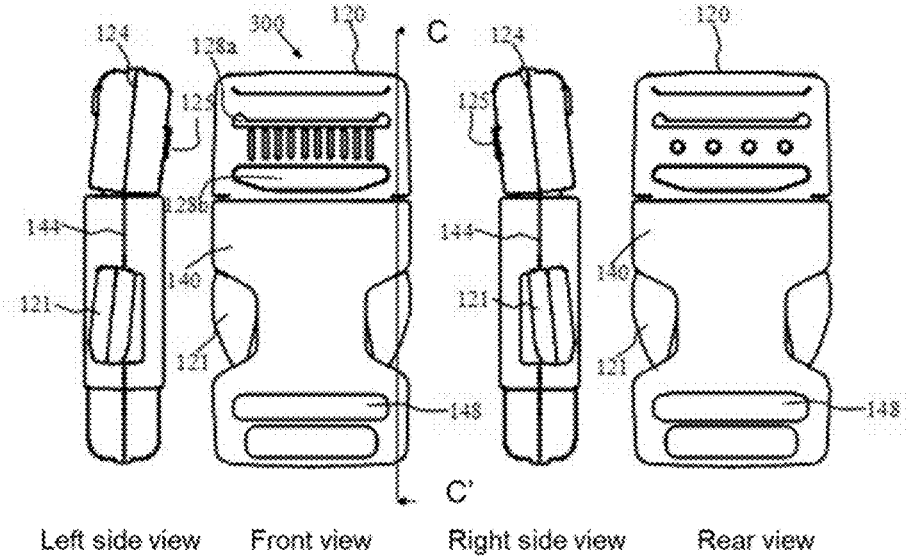
<Bent forward state>

[FIG. 3-2]
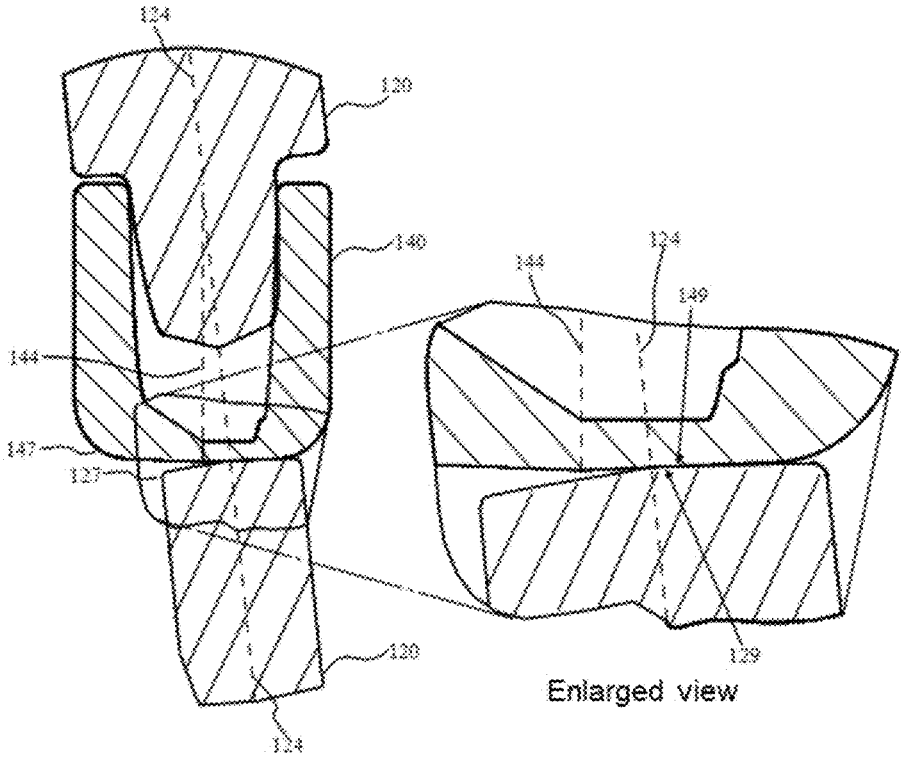
Partial cross-sectional view taken along line C-C'
[FIG. 3-3]
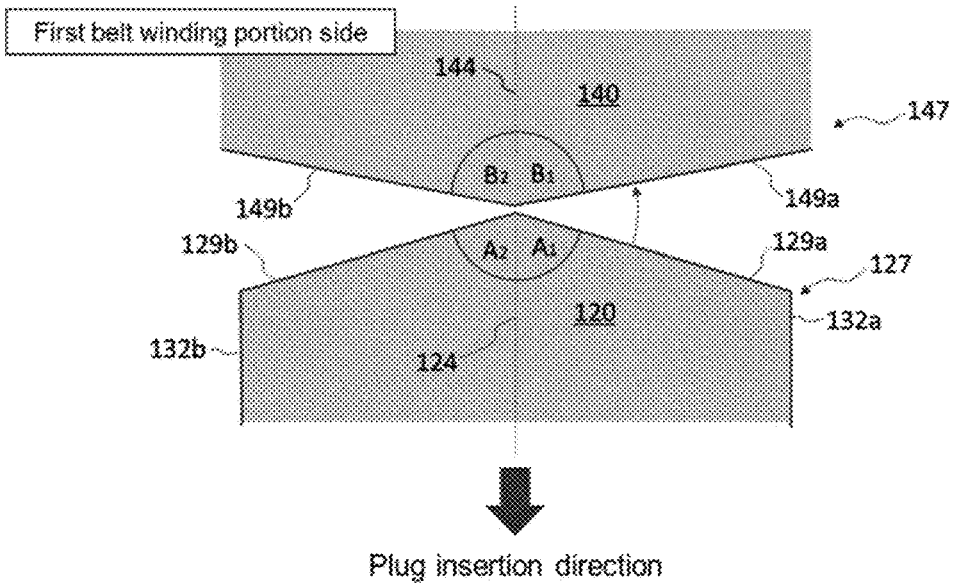

SIDE-RELEASE BUCKLE

CROSS-REFERENCE TO RELATED APPLICATIONS

This application is a U.S. National Stage entry of PCT Application No: PCT/JP2017/033603 filed on Sep. 15, 2017, the contents of which are incorporated herein by reference.

TECHNICAL FIELD

The present invention relates to a side-release buckle used for connecting belts and having a pair of leg portions (lock arms) on both sides.

BACKGROUND ART

Conventionally, in addition to belts, in order to connect ends of belts attached to various articles such as bags, rucksacks, clothes, shoes, helmets, sporting goods, and wrappers, buckles for detachably engaging a plug and a socket are used. In such buckles, it is required that the operation for attaching and detaching be easy, and at the same time that buckles should not come off accidentally when not intended. As a product meeting such a demand, a side-release buckle having a pair of leg portions on both sides is known.

Generally, a side-release buckle includes a plug and a socket each having a belt mounting portion. The plug comprises a base portion having a belt mounting portion, and a pair of left and right leg portions (lock arms) protruding from the base portion. An engaging portion is formed on each of the leg portions. The socket has a hollow tubular main body, and the main body has a housing space (cavity) for inserting both leg portions of the plug. The socket has a portion to be engaged with which the engaging portion can be engaged, and the engaging portion of the leg portion of the plug can be inserted into the socket and engage with the portion to be engaged of the socket, so that the plug and the socket are in a locked state. The engaging portion of the plug and the portion to be engaged of the socket have surfaces facing each other (hereinafter, the plug side is referred to as an "engaging surface" and the socket side is referred to as a "surface to be engaged") when in the locked state. Openings communicating with the housing space are formed on both sides of the socket main body, and the pair of leg portions exposed from the openings can be pressed in a direction approaching each other to elastically deform, whereby the engagement can be released, and the plug and the socket can be separated.

In such a side-release buckle, a technique for preventing breakage of leg portions is known. For example, Japanese Patent Publication No. 2010-022807 discloses that by forming three protruding surfaces on the leg portions of a plug (male latch) to increase the coupling area with a socket (female receptacle), it is possible to increase the coupling force of the buckle. Further, it is described that since the forces are distributed to the three protruding surfaces, breakage of the protruding portion of the plug (male latch) can be prevented.

In addition, Japanese Patent Publication No. 2009-011492 proposes connecting a pair of leg portions with a connecting band having elasticity. The connecting band is a thin plate-shaped member integrally formed with the leg portions and the like, and connects the pair of leg portions in a state of being curved approximately in a U-shape. The connecting band prevents the pair of leg portions from being deformed outwardly, and serves to prevent breakage of the leg portions when excessive tensile force (outward tensile force) is applied to the leg portions.

CITATION LIST

Patent Literature

[Patent Literature 1] Japanese Patent Publication No. 2010-022807

[Patent Literature 2] Japanese Patent Publication No. 2009-011492

SUMMARY OF INVENTION

As described above, techniques that aim at preventing the leg portions from being damaged in a side-release buckle is known. However, the technique disclosed in Japanese Patent Publication No. 2010-022807 can prevent the breakage of the protrusion of the leg portion, that is, the engaging portion, but is not very useful for preventing the other portion of the leg portion, particularly the leg portion from being broken. Besides, the technique described in Japanese Patent Publication No. 2009-011492 has a high effect of preventing breakage of the leg portion when a tensile force is applied in a direction in which the leg portion is opened outwardly. However, the effect of preventing the leg portion from being broken is low when a tensile force is applied from belts on both sides in a direction in which the plug and the socket are separated from each other.

In a buckle, when the plug and the socket are locked by an insertion engagement, tensile force may be applied from the belts on both sides in the direction in which the plug and the socket are separated from each other due to various external factors. When such a tensile force is repeatedly applied or a strong tensile force is applied, a crack may be formed in the leg portion, and the leg portion may be finally broken. The conventional side-release buckle has not been sufficiently studied to prevent the leg portion from breaking in such a case, and there is still room for improvement. It is practically advantageous to be able to suppress the breakage of the leg portion from the viewpoint of increasing the reliability of the buckle. Therefore, an object of the present invention is to provide a side-release buckle in which the leg portions are hard to be broken when a tensile force is applied from the belts on both sides in a direction in which the plug and the socket are separated from each other.

The present inventor has investigated into the movement of the plug and the socket in a side-release buckle when a tensile force is applied from the belts on both sides in the direction in which the plug and the socket are separated from each other. As a result, it has been found that a force is applied to the plug in a direction of slightly bending forward with respect to the socket. Further, it has been found that when a force is applied in the direction of bending forward, bending stress is applied to the leg portions of the plug, which causes the leg portions to break. Therefore, the present inventor has conducted an intensive investigation on the causes of the force applied in the direction of bending forward and found the following causes.

In a side-release buckle, a belt winding portion for winding and fixing the belt is provided in the belt mounting portion of the plug. The belt winding portion is often provided at a position offset with respect to the mold mating surface defined by a first parting line of the plug to allow for adjustment of the length of the belt while preventing the wound belt from coming off easily. For this reason, when a tensile force is applied from the belts on both sides in the direction in which the plug and the socket in the locked state are separated from each other, a force is applied to the plug in a direction of bending forward with respect to the socket.

Plugs and sockets are molded products, and generally leave a parting line when removed from a mold. FIG. 3-2 shows schematic sectional view of the engaging surface (129) and the surface to be engaged (149) of a conventional side-release buckle, which will be described later, observed from a direction that is an in-plane direction of the mold mating surface defined by the first parting line (124) of the plug (120), and is also a direction perpendicular to the insertion direction when the plug (120) and the socket (140) are in a locked state by an insertion engagement.

Referring to FIG. 3-3, the engaging surface (129) of the plug can be classified into an engaging surface (129*a*) on the opposite side to the belt winding portion, and an engaging surface (129*b*) on the same side as the belt winding portion, assuming that the parting line (124) is a boundary. Similarly, the surface to be engaged (149) of the socket can be classified into a surface to be engaged (149*a*) on the opposite side to the belt winding portion (144), and a surface to be engaged (149*b*) on the same side as the belt winding portion, assuming that the parting line (144) is a boundary.

Each of the engaging surface (129) and the surface to be engaged (149) needs to have a mountain-like shape with the end point of the parting line as a vertex in order to be able to take them out of a mold. The present inventor has found that there is a clearance between the engaging surface (129*a*) and the surface to be engaged (149*a*), and when the above-described tensile force is applied, the engaging surface (129*a*) on the opposite side to the belt winding portion of the plug with respect to the parting line is easily bent forward in the direction approaching the surface to be engaged (149*a*) (the direction of the arrow in FIG. 3-3).

As a result of the above investigation, the present inventor has found that by reducing the clearance between the engaging surface (129*a*) of the plug and the surface to be engaged (149*a*) of the socket provided that they can be taken out of the mold, when a tensile force is applied from the belts on both sides in the direction in which the plug and the socket are separated from each other, the forward bending of the plug and, consequently, the breakage of the leg portions can be suppressed. The present invention has been completed on the basis of the findings and is exemplified below.

According to one aspect of the present invention, a buckle is a side-release buckle comprising a plug and a socket for inserting and engaging the plug, the plug comprising a first parting line, a base portion having a first belt mounting portion, a pair of leg portions protruding from the base portion, and an engaging portion formed on each of the leg portions;

the engaging portion comprising an engaging surface;

the first belt mounting portion comprising an insertion hole for inserting a belt, and a first belt winding portion traversing the insertion hole at a position offset with respect to a first mold mating surface defined by the first parting line;

the socket comprising a second parting line, a main body having a second belt mounting portion and an insertion port, a housing space formed in the main body and capable of housing the leg portions inserted from the insertion port, and a portion to be engaged formed on the main body and engageable with the engaging portion;

the portion to be engaged comprising a surface to be engaged that faces the engaging surface when engaged with the engaging portion; wherein when a cross section of the engaging surface is observed from a direction that is an in-plane direction of the first mold mating surface defined by the first parting line of the plug, and is also a direction perpendicular to an insertion direction, the engaging surface is located on an opposite side to the first belt winding portion with respect to the first mold mating surface, and has a first engaging surface forming with the first mold mating surface an angle $A_1$ of 87° or more and 90° or less.

In one embodiment of the buckle according to the present invention, when a cross section of the engaging surface is observed from the direction that is an in-plane direction of the first mold mating surface, and is also a direction perpendicular to the insertion direction, the engaging surface is located on the same side as the first belt winding portion with respect to the first mold mating surface, and has a second engaging surface forming with the first mold mating surface an angle $A_2$ smaller than the angle $A_1$.

In another embodiment of the buckle according to the present invention, in a state where the plug and the socket are in an inserted engagement state, when a cross section of the surface to be engaged is observed from a direction that is an in-plane direction of a second mold mating surface defined by the second parting line, and is also a direction perpendicular to the insertion direction, assuming that the second parting line is a boundary, the surface to be engaged is classified into a first surface to be engaged on an opposite side to the first belt winding portion and a second surface to be engaged on the same side with the first belt winding portion, and an angle $B_1$ between the first surface to be engaged and the second mold mating surface is 87° or more and 90° or less.

In still another embodiment of the buckle according to the present invention, assuming that an angle between the second surface to be engaged and the second mold mating surface is $B_2$, $A_1 \geq B_1$ and $A_1 \geq B_2$ are satisfied, respectively.

In still another embodiment of the buckle according to the present invention, $A_2 \geq B_1$ and $A_2 \geq B_2$ are satisfied, respectively.

In still another embodiment of the buckle according to the present invention, when a cross section of the engaging portion of the plug is observed from a direction that is an in-plane direction of the first mold mating surface defined by the first parting line, and is also a direction perpendicular to the insertion direction, the first parting line is offset with respect to a virtual center line of the engaging portion extending in the insertion direction.

In still another embodiment of the buckle according to the present invention, the first parting line is located on a side opposite to the first belt winding portion with respect to the center line.

In still another embodiment of the buckle according to the present invention, in a state where the plug and the socket are in an inserted engagement state, the first mold mating surface defined by the first parting line of the plug and the second mold mating surface defined by the second parting line of the socket are on different planes.

In still another embodiment of the buckle according to the present invention, regarding the engagement portion, when a distance between a side surface on a same side as the first belt winding portion and a side surface on an opposite side to the first belt winding portion is $D_1$, and a distance between the first parting line and the side surface on the opposite side to the first belt winding portion is $D_2$, $D_2/D_1 \leq 0.5$ is satisfied.

In still another embodiment of the buckle according to the present invention, the second belt mounting portion comprises:

an insertion hole for inserting a belt; and a second belt winding portion traversing the insertion hole at a position offset closer to the first belt winding portion with respect to the second mold mating surface defined by the second parting line.

According to one aspect of the present invention, an article comprising the buckle according to the present invention is provided.

Regarding the side-release buckle according to the present invention, forward bending of the plug is suppressed when a tensile force is applied from the belts on both sides in a direction in which the plug and the socket are separated from each other. Therefore, according to the present invention, when tensile force is applied from the belts on both sides in the direction in which the plug and the socket are separated from each other, the bending stress on the leg is reduced, and the leg is less likely to be broken. This is a practically advantageous effect and makes it possible to improve the reliability of the side-release buckle.

BRIEF DESCRIPTION OF THE DRAWINGS

FIG. 1-1 is a perspective view of a side-release buckle according to a first embodiment of the present invention wherein a plug and a socket are in a separated state. (b) is a partial enlarged view when the vicinity of the area surrounded by the circle in (a) is observed from the opposite direction.

FIG. 1-2 is a front view, a rear view, a right side view, and a left side view of the side-release buckle according to the first embodiment of the present invention wherein the plug and the socket are in a locked state and both parting lines are in a parallel state (standing state).

FIG. 1-3 is an enlarged cross-sectional view of the vicinity of the engaging portion of the plug and the portion to be engaged of the socket, taken along the line A-A' of FIG. 1-2.

FIG. 1-4 is a front view, a rear view, a right side view, and a left side view of the side-release buckle according to the first embodiment of the present invention, wherein the plug and the socket are in a locked state and the plug is in a bent forward state.

FIG. 1-5 is an enlarged cross-sectional view of the vicinity of the engaging portion of the plug and the portion to be engaged of the socket, taken along the line A-A' of FIG. 1-4.

FIG. 1-6 is a schematic cross-sectional view of the engaging surface and the surface to be engaged of the side-release buckle according to the first embodiment of the present invention, in which the plug and the socket are locked, observed from an in-plane direction of the first mold mating surface defined by the first parting line of the plug, and from an direction perpendicular to an insertion direction (a case in which the contour of the engaging surface and the surface to be engaged is linear).

FIG. 1-7 is a schematic cross-sectional view of the engaging surface and the surface to be engaged of the side-release buckle according to the first embodiment of the present invention, in which the plug and the socket are locked, observed from an in-plane direction of the first mold mating surface defined by the first parting line of the plug, and from an direction perpendicular to an insertion direction (a case in which at least a part of the contour of the engaging surface and the surface to be engaged is not linear).

FIG. 2-1 is a front view, a rear view, a right side view, and a left side view of the side-release buckle according to a second embodiment of the present invention wherein the plug and the socket are in a locked state and both parting lines are in a parallel state (standing state).

FIG. 2-2 is an enlarged cross-sectional view of the vicinity of the engaging portion of the plug and the portion to be engaged of the socket, taken along the line B-B' of FIG. 2-1.

FIG. 2-3 is a schematic cross-sectional view of the engaging surface and the surface to be engaged of the side-release buckle according to the second embodiment of the present invention, in which the plug and the socket are locked, observed from an in-plane direction of the first mold mating surface defined by the first parting line of the plug, and from an direction perpendicular to an insertion direction.

FIG. 3-1 is a front view, a rear view, a right side view, and a left side view of the side-release buckle according to an conventional example wherein the plug and the socket are in a locked state and the plug is in a bent forward state.

FIG. 3-2 is an enlarged cross-sectional view of the vicinity of the engaging portion of the plug and the portion to be engaged of the socket, taken along the line C-C' of the side-release buckle shown in FIG. 3-1.

FIG. 3-3 is a schematic cross-sectional view of the engaging surface and the surface to be engaged of the side-release buckle according to the conventional example, in which the plug and the socket are locked, observed from an in-plane direction of the first mold mating surface defined by the first parting line of the plug, and from an direction perpendicular to an insertion direction.

DESCRIPTION OF THE PREFERRED EMBODIMENTS

Hereinafter, embodiments of the present invention will be described in detail with reference to the figures. However, the present invention is not limited to these embodiments.

In this specification, the direction in which the plug is inserted into the socket is defined as the downward direction, and the direction in which the plug is removed from the socket is defined as the upward direction (for example, corresponding to the up-down direction on the paper surface in the front view of FIG. 1-2). The direction connecting the tips of the two leg portions of the plug is defined as the right-left direction (for example, corresponding to the right-left direction on the paper surface in the front view of FIG. 1-2). Also, a direction perpendicular to both the up-down direction and the right-let direction is defined as the front-back direction (for example, corresponding to the front-back direction on the paper surface in the front view of FIG. 1-2).

First Embodiment

FIG. 1-1(*a*) is a perspective view of the side-release buckle (100) according to the first embodiment of the present invention when the plug (120) and the socket (140) are in a separated state. FIG. 1-1(*b*) is a partial enlarged view of the vicinity of the area surrounded by the circle in (a). FIG. 1-2 is a front view, a rear view, a right side view, and a left side view of the side-release buckle (100) wherein the plug (120) and the socket (140) are in a locked state and both parting lines are in a parallel state. FIG. 1-3 is an enlarged cross-sectional view of the vicinity of the engaging portion (127) of the plug (120) and the portion to be engaged (147) of the socket (140), taken along the line A-A' of FIG. 1-2. FIG. 1-4 is a front view, a rear view, a right side view, and a left side view of the side-release buckle (100), wherein the plug (120) and the socket (140) are in a locked state and the plug (120) is in a bent forward state. FIG. 1-5 is an enlarged cross-sectional view of the vicinity of the engaging portion of the plug and the portion to be engaged of the socket, taken along the line A-A' of FIG. 1-4. FIG. 1-6 is a schematic cross-sectional view of the engaging surface and the surface to be engaged of the side-release buckle (100), in which the plug (120) and the socket (140) are locked, observed from an a direction that is an in-plane direction of the mold mating surface defined by the first parting line (124) of the plug (120), and is also a direction perpendicular to an insertion direction.

The side-release buckle (100) comprises a plug (120) and a socket (140) into which the plug (120) is inserted and engaged. In the side-release buckle (100), the plug (120) can be inserted into the socket (140) and engage with it. In FIG. 1-1, the two are separated, and in FIG. 1-2 and FIG. 1-4, the two are locked. The material of the plug (120) and the socket (140) is not particularly limited, but is preferably flexible, and may be, for example, a synthetic resin or a metal.

The plug (120) comprises a first parting line (124), a base portion (122) having a first belt mounting portion (126), a pair of leg portions (121) protruding from the base portion (122), and an engaging portion (127) formed on each of the leg portions (121).

The plug (120) can be integrally formed by injection molding, casting, or the like, and the first parting line (124) is generated when the plug (120) is removed from a mold. The first parting line (124) orbits the plug so that a first mold mating surface defined thereby is parallel to the insertion direction.

The first belt mounting portion (126) comprises an insertion hole (128) for inserting a belt, and a first belt winding portion (125) traversing the insertion hole (128) at a position offset with respect to the first mold mating surface defined by the first parting line (124). In the first embodiment, the first belt winding portion (125) is provided so as to cross the insertion hole (128) in the right-let direction, at a position offset from the first mold mating surface to the front side of the paper surface when viewed from the front view of FIG. 1-2. The first belt winding portion (125) divides the insertion hole (128) into two, that is an upper insertion hole (128*a*) and a lower insertion hole (128*b*). The length of the belt (not shown) can be adjusted by winding a belt around the first belt winding portion (125) using the upper insertion hole (128*a*) and the lower insertion hole (128*b*). Further, since the first belt winding portion (125) is offset with respect to the first mold mating surface, after the length is adjusted, the belt will not easily be detached from the first belt mounting portion (126).

The pair of leg portions (121) extend downward from both left and right sides of the base portion (122). Each of the pair of leg portions (121) is elastically deformable in a direction away from each other and in a direction approaching each other (right-let direction). It is preferable that the pair of leg portions (121) be formed symmetrically from the viewpoint of operability and aesthetic appearance. Each of the pair of leg portions (121) has an engaging portion (127) projecting outward in the right-let direction. The engagement portion (127) has an engaging surface (129). When a tensile force is applied from both belts in a direction in which the plug and the socket are separated from each other in a state where the engaging portion (127) is engaged with the portion to be engaged (147) of the socket described later, the engaging surface (129) abuts against the surface to be engaged (149) of the portion to be engaged (147) to resist the tensile force and to prevent the plug and the socket from separating.

One or a plurality of guide bars (123) extend downward from the base portion (122) between the pair of leg portions (121). The guide bar (123) plays a role of a guide when inserting the plug (120) into the socket (140) and a role of maintaining the posture of the buckle when in a locked state.

Assuming that the first parting line (124) is a boundary, the engaging surface (129) can be classified into a first engaging surface (129*a*) on the opposite side to the first belt winding portion (125), and a second engaging surface (129*b*) on the same side as the first belt winding portion (125). Referring to FIG. 1-6, from the viewpoint of effectively suppressing forward bending of the plug provided that the plug can be taken out of a mold, it is preferable that, when a cross section of the engaging surface (129) is observed from a direction that is an in-plane direction of the first mold mating surface defined by the first parting line (124) of the plug (120), and is also a direction perpendicular to an insertion direction, an angle $A_1$ formed by the first engaging surface (129*a*) and the first mold mating surface is 87° or more and 90° or less, more preferably 88° or more and 90° or less. In this way, the first engaging surface (129*a*) is brought close to a right angle with respect to the first mold mating surface as much as possible, whereby the plug can be taken out of a mold while the clearance between the first engaging surface (129*a*) and the surface to be engaged (149*a*) is reduced, and the forward bending of the plug can be suppressed.

Further, when a cross section of the engaging surface (129) is observed from the direction that is an in-plane direction of the first mold mating surface, and is also a direction perpendicular to an insertion direction, an angle $A_2$ of the second engaging surface (129*b*) inclined with respect to the first mold mating surface is preferably smaller than the angle $A_1$. Even if the angle $A_2$ is increased, the effect of suppressing the forward bending can not be obtained, so that it is more advantageous to make the angle $A_2$ smaller in order to make it easier to remove from the mold. For example, the angle $A_2$ can be 90° or less, preferably 89° or less, and more preferably 88° or less. However, if the angle $A_2$ is too small, the inclination of the second engaging surface (129*b*) becomes too large, and problems such as the engaging surface (129) not appearing flat may be caused. This is undesirable from a viewpoint of design. Therefore, it is preferably 85° or more, more preferably 86° or more, and even more preferably 87° or more.

The socket (140) comprises a second parting line (144), a main body (142) having a second belt mounting portion (146) and an insertion port (143), a housing space (141) formed in the main body (142) and capable of housing the leg portions (121) inserted from the insertion port (143), and a portion to be engaged (147) formed on the main body (142) and engageable with the engaging portion (127).

The socket (140) can also be integrally formed by injection molding, casting, or the like, and the second parting line (144) is generated when the socket is removed from a mold. The second parting line (144) orbits the socket so that a second mold mating surface defined thereby is parallel to the insertion direction.

The second belt mounting portion (146) comprises an insertion hole (148) for inserting a belt, and a second belt winding portion (125) traversing the insertion hole (148). The second belt winding portion (145) is provided so as to cross the insertion hole (148) in the right-let direction. The second belt winding portion (145) may be formed so that its central axis is located in the in-plane direction of the second mold mating surface defined by the second parting line (144), or may be provided at a position offset with respect to the mold mating surface. From the viewpoint of enhancing the adjuster function of the belt, the second belt mounting portion (146) is preferably configured such that the second belt winding portion (145) traverses the insertion hole (148) at a position offset closer to the first belt winding portion (125) with respect to the second mold mating surface defined by the second parting line (144).

An opening (150) communicating with the housing space (141) are formed on both left and right sides of the socket main body (142), and when the plug is inserted and engaged, the leg portions are exposed from the opening (150). The pair of leg portions (121) exposed from the opening (150) is pressed in a direction close to each other and elastically deformed, whereby the engagement is released, and the plug (120) and the socket (140) can be separated. A portion to be engaged (147) can be provided on the upper peripheral edge of the opening (150).

A rail (151) for guiding the insertion direction of the guide bar (123) is provided on the inner wall defining the housing space (141) of the socket (140).

The portion to be engaged (147) has a surface to be engaged (149) that faces the engaging surface (129) when engaged with the engaging portion (127) of the plug. Assuming that the second parting line (144) is a boundary, the surface to be engaged (149) is classified into a first surface to be engaged (149*a*) on the opposite side to the first belt winding portion (125), and a second surface to be engaged (149*b*) on the same side as the first belt winding portion (125). Referring to FIG. 1-6, from the viewpoint of suppressing the forward bending of the plug, when a cross section of the surface to be engaged (149) is observed from a direction that is an in-plane direction of a second mold mating surface, and is also a direction perpendicular to the insertion direction, it is preferable that an angle $B_1$ between the first surface to be engaged (149*a*) and the second mold mating surface be 87° or more and 90° or less, more preferably 88° or more and 90° or less. Further, to obtain the same performance even if the plug is inserted in the socket with the plug turned back, when the cross section of the surface to be engaged (149) is observed from a direction that is an in-plane direction of a second mold mating surface, and is also a direction perpendicular to the insertion direction, it is preferable that an angle $B_2$ between the second surface to be engaged (149*b*) and the second mold mating surface be 87° or more and 90° or less, more preferably 88° or more and 90° or less. It is still more preferable that $B_1=B_2$.

However, the socket has a hollow shape and requires a core for molding. When the outer mold and the core accidentally come into contact with each other, the surface to be engaged (149) is preferably inclined with respect to the second mold mating surface so that they are less likely to be damaged. Therefore, it is preferable that $B_1$ and $B_2$ be smaller than $A_1$ and $A_2$, respectively. Specifically, it is preferable that $A_1 \geq B_1$ and $A_1 \geq B_2$ be satisfied, respectively, and it is more preferable that $A_2 \geq B_1$ and $A_2 \geq B_2$ be satisfied, respectively. Further, it is more preferable that $A_1 > B_1$ and $A_1 > B_2$ be satisfied, respectively. Further, it is more preferable that $A_2 > B_1$ and $A_2 > B_2$ be satisfied, respectively.

Here, a method for measuring the angles $A_1$, $A_2$, $B_1$, and $B_2$ described above will be described. When the cross section of the engaging surface (surface to be engaged) whose angle is to be measured is observed from the predetermined observation direction described above, a circle with a radius R with the vertex (O) of the engaging surface (surface to be engaged) as a center is determined. The angle formed by the straight line connecting the circle and the intersection P of the engaging surface (surface to be engaged) and the first parting line (124) (the second parting line (144)) is defined as a measured value. The radius R has 40% of the length of a perpendicular line drawn from the vertex (O) to the extension line of the contour of the side surface connected to the engaging surface (surface to be engaged) whose angle is to be measured. FIG. 1-6 exemplarily shows a method for measuring the angle $A_1$. When measuring the angle $A_1$, 40% of the length of the perpendicular line (H) drawn from the vertex (O) to the extension line (E) of the contour of the side surface (132*a*) connected to the first engaging surface (129*a*), that is, the length 0.4H is defined as the radius R. In addition, as shown in FIG. 1-7, in the cross-sectional observation, a part or all of the contour of the engaging surface or the surface to be engaged may appear in a shape other than a straight line (for example, a curved shape). Even in that case, each angle can be measured in the same manner.

However, from the viewpoint of suppressing the forward bending of the plug (120), with respect to the length of a perpendicular line drawn from the vertex (O) to the extension line of the contour of the side surface connected to the engaging surface (surface to be engaged), it is preferable that the engaging surface (surface to be engaged) has a straight contour from the vertex (O) over 50% of the length of perpendicular line or more, more preferably has a straight contour from the vertex (O) over 70% of the length of the perpendicular line or more, more preferably has a straight contour from the vertex (O) over 90% of the length of the perpendicular line or more (see FIG. 1-6).

In this embodiment, in a state where the plug (120) and the socket (140) are in an inserted engagement state, the first mold mating surface defined by the first parting line (124) of the plug (120) and the second mold mating surface defined by the second parting line (144) of the socket (140) are on the same plane. However, the two may be on different planes as well.

Second Embodiment

FIG. 2-1 is a front view, a rear view, a right side view, and a left side view of the side-release buckle (200) according to a second embodiment of the present invention wherein the plug (120) and the socket (140) are in a locked state. FIG. 2-2 is an enlarged cross-sectional view of the vicinity of the engaging portion (127) of the plug (120) and the portion to be engaged (147) of the socket (140), taken along the line B-B' of the side-release buckle (200) in FIG. 2-1. Further, FIG. 2-3 is a schematic cross-sectional view of the engaging surface (129) and the surface to be engaged (149) of the side-release buckle (200), in which the plug (120) and the socket (140) are locked, observed from a direction that is an in-plane direction of the first mold mating surface defined by the first parting line (124) of the plug (120), and is also a direction perpendicular to an insertion direction. In FIG. 2-1, FIG. 2-2, and FIG. 2-3, when the same reference numerals as FIG. 1-1, FIG. 1-2, FIG. 1-3, FIG. 1-4, FIG. 1-5, FIG. 1-6, FIG. 1-7 are used, unless otherwise noted, they indicate the same components, so the description is omitted.

Referring to FIG. 2-3, in the side-release buckle (200) according to the second embodiment, in a state where the plug (120) and the socket (140) are in an inserted engagement state, the first mold mating surface defined by the first parting line (124) of the plug (120) and the second mold mating surface defined by the second parting line (144) of the socket (140) are on different planes. In this respect, it differs from the side release buckle according to the first embodiment.

If the first mold mating surface and the second mold mating surface are on different planes, when observed from the direction described in FIG. 2-3, it is preferable that the first parting line (124) of the plug be located on the side opposite to the first belt winding portion (125) with respect to the parting line (144). With this configuration, the contact area between the engaging surface (129) of the plug and the surface to be engaged (149) of the socket increases when a tensile force is applied from the belts on both sides in the direction of separating the plug and the socket. Thus, the resistance against the movement of the plug to bend forward can be increased.

When the cross section of the engaging surface (129) is observed from a direction that is an in-plane direction of the first mold mating surface defined by the first parting line (124) of the plug (120), and is also an direction perpendicular to an insertion direction, it is preferable that the first parting line (124) be offset with respect to a virtual center line (M) of the engaging portion (127) extending in the insertion direction. Further, in this case, it is preferable that the first parting line (124) is located on the opposite side to the first belt winding portion (125) with respect to the center line (M). Since the first parting line (124) is offset on the side opposite to the first belt winding portion (125) with respect to the center line (M), the effect of suppressing the forward bending of the plug increases. Besides, the center line (M) is a set of points equidistant from both side surfaces (132*a*, 132*b*) of the engaging portion (127).

From the viewpoint of increasing the contact area between the engaging surface (129) of the plug and the surface to be engaged (149) of the socket and suppressing the forward bending of the plug, it is preferable that the first parting line (124) be close to the side surface (132*a*) opposite to the belt winding portion of the portion (127). Therefore, regarding the engagement portion (127), when a distance between a side surface (132*b*) on the same side as the first belt winding portion (125) and a side surface (132*a*) on the opposite side to the first belt winding portion is $D_1$, and a distance between the first parting line (124) and the side surface (132*a*) on the opposite side to the first belt winding portion (125) is $D_2$, it is preferable that $D_2/D_1 \leq 0.5$, and more preferably $D_2/D_1 \leq 0.25$, and still more preferably $D_2/D_1 \leq 0.01$. However, when $D_2$ is set to 0, it is difficult to remove the molded article from a mold, so that $0.01 \leq D_2/D_1$ is preferable.

When the plug (120) and the socket (140) are in an inserted engagement state, the first mold mating surface defined by the first parting line (124) of the plug (120), and the second mold mating surface defined by the second parting line (144) of the socket (140), may be parallel. Thereby, there is an advantage that a mold can be easily manufactured and the manufacturing cost can be suppressed.

In the second embodiment, from the viewpoint of increasing the contact area between the engaging surface (129) of the plug and the surface to be engaged (149) of the socket and suppressing the forward bending of the plug, when the plug (120) and the socket (140) are in an inserted engagement state, it is preferable that the angle $A_2$ and the angle $B_1$ be close. If the angle difference between the two is small, the engaging surface (129) and the surface to be engaged (149) become closer to parallel, so that the clearance for bending forward can be significantly reduced. Specifically, the angle difference between the two is preferably 1.5° or less, more preferably 1° or less, still more preferably 0.5° or less, and the most preferably 0°.

CONVENTIONAL EXAMPLE

FIG. 3-1 is a front view, a rear view, a right side view, and a left side view of the side-release buckle (300) according to an conventional example wherein the plug (120) and the socket (140) are in a locked state. FIG. 3-2 is an enlarged cross-sectional view of the vicinity of the engaging portion (127) of the plug (120) and the portion to be engaged (147) of the socket (140), taken along the line C-C' of the side-release buckle (300). Further, FIG. 3-3 is a schematic cross-sectional view of the engaging surface (129) and the surface to be engaged (149) of the side-release buckle (300), in which the plug (120) and the socket (140) are locked, observed from a direction that is an in-plane direction of the first mold mating surface defined by the first parting line (124) of the plug (120), and is also a direction perpendicular to an insertion direction. In FIG. 3-1, FIG. 3-2, and FIG. 3-3, when the same reference numerals as FIG. 1-1, FIG. 1-2, FIG. 1-3 are used, unless otherwise noted, they indicate the same components, so the description is omitted.

The side-release buckle (300) according to the conventional example differs from the side-release buckle (100) according to the first embodiment of the present invention in that the angle $A_1$ is smaller. In the conventional example, since the clearance between the engaging surface (129) of the plug and the surface to be engaged (149) of the socket is large, the plug is easily bent forward with respect to the socket. Furthermore, the side-release buckle (300) according to the comparative example is different from the side-release buckle (100) according to the first embodiment of the present invention in that the angle $B_1$ is smaller. This also makes it easier for the plug to be bent forward toward the socket. Therefore, when a tensile force is applied to the side-release buckle (300) according to the conventional example from the belts on both sides in the direction in which the plug and the socket are separated from each other, the load on the leg portions increases due to the forward bending of the plug, so it will be understood that the leg portions are more likely to be damaged.

INDUSTRIAL APPLICABILITY

The side-release buckle according to the present invention is applicable to various articles that require an operation of joining and separating the ends of belts. For example, in addition to belt products such as waist belts, shoulder belts, and combat belts (warrior belts), belt parts of various articles such as bags, rucksacks, clothes, PFDs (life jackets), helmets, sports equipment, shoes, and packaging.

REFERENCE SIGNS LIST

100, 200, 300 Side-release buckle
120 Plug
121 Leg portion
122 Base portion
123 Guide bar
124 First Parting Line
125 First belt winding portion
126 First belt mounting portion
127 Engaging portion
128 (128*a*, 128*b*) Insertion hole
129 (129*a*, 129*b*) Engaging surface
132 (132*a*, 132*b*) Side surface
140 Socket
141 Housing space
142 Main body
143 Insertion port
144 Second parting line
145 Second belt winding portion
146 Second belt mounting portion

147 Portion to be engaged
148 Insertion hole
149 (149*a*, 149*b*) Surface to be engaged
150 Opening
151 Rail

What is claimed is:

1. A side-release buckle, comprising:

a plug; and a socket for inserting and engaging the plug, the plug comprising a first parting line, a base portion having a first belt mounting portion, a pair of leg portions protruding from the base portion, and an engaging portion formed on each of the leg portions, the engaging portion comprising an engaging surface, the first belt mounting portion comprising an insertion hole for inserting a belt, and a first belt winding portion traversing the insertion hole at a position offset with respect to a first mold mating surface defined by the first parting line, the socket comprising a second parting line, a main body having a second belt mounting portion and an insertion port, a housing space formed in the main body and capable of housing the leg portions inserted from the insertion port, and a portion to be engaged formed on the main body and engageable with the engaging portion, and the portion to be engaged comprising a surface to be engaged that faces the engaging surface when engaged with the engaging portion, wherein, when a cross section of the engaging surface is observed from a direction that is an in-plane direction of the first mold mating surface defined by the first parting line of the plug and is also a direction perpendicular to an insertion direction, the engaging surface is located on an opposite side to the first belt winding portion with respect to the first mold mating surface, and has a first engaging surface forming with the first mold mating surface an angle $A_1$ of 87° or more and 90° or less.

2. The buckle according to claim 1, wherein, when the cross section of the engaging surface is observed from the direction that is the in-plane direction of the first mold mating surface, and is also the direction perpendicular to the insertion direction, the engaging surface is located on a same side as the first belt winding portion with respect to the first mold mating surface, and has a second engaging surface forming with the first mold mating surface an angle $A_2$ smaller than the angle $A_1$.

3. The buckle according to claim 1, wherein, in a state where the plug and the socket are in an inserted engagement state, when a cross section of a surface to be engaged is observed from a direction that is an in-plane direction of a second mold mating surface defined by the second parting line, and is also the direction perpendicular to the insertion direction, assuming that the second parting line is a boundary, the surface to be engaged is classified into a first surface to be engaged on an opposite side to the first belt winding portion and a second surface to be engaged on a same side with the first belt winding portion, and an angle $B_1$ between the first surface to be engaged and the second mold mating surface is 87° or more and 90° or less.

4. The buckle according to claim 3, wherein, assuming that an angle between the second surface to be engaged and the second mold mating surface is $B_2$, $A_1 \geq B_1$ and $A_1 \geq B_2$ are satisfied, respectively.

5. The buckle according to claim 4, wherein $A_2 \geq B_1$ and $A_2 \geq B_2$ are satisfied, respectively.

6. The buckle according to claim 3, wherein, in the state where the plug and the socket are in the inserted engagement state, the first mold mating surface defined by the first parting line of the plug and the second mold mating surface defined by the second parting line of the socket are on different planes.

7. The buckle according to claim 6, wherein, regarding the engaging portion, when a distance between a side surface on a same side as the first belt winding portion and a side surface on the opposite side to the first belt winding portion is $D_1$, and a distance between the first parting line and the side surface on the opposite side to the first belt winding portion is $D_2$, $D_2/D_1 \leq 0.5$ is satisfied.

8. The buckle according to claim 1, wherein, when the cross section of the engaging portion of the plug is observed from the direction that is the in-plane direction of the first mold mating surface defined by the first parting line, and is also the direction perpendicular to the insertion direction, the first parting line is offset with respect to a virtual center line of the engaging portion extending in the insertion direction.

9. The buckle according to claim 8, wherein the first parting line is located on a side opposite to the first belt winding portion with respect to the center line.

10. The buckle according to claim 3, wherein the second belt mounting portion comprises:

an insertion hole for inserting a belt; and a second belt winding portion traversing the insertion hole at a position offset closer to the first belt winding portion with respect to the second mold mating surface defined by the second parting line.

11. An article comprising the buckle according to claim 1.

* * * * *